United States Patent [19]

Maneki

[11] Patent Number: 4,576,408

[45] Date of Patent: Mar. 18, 1986

[54] CHOPSTICK HOLDER

[76] Inventor: Satome Maneki, 3445 N. Verdugo Rd., Glendale, Calif. 91208

[21] Appl. No.: 561,834

[22] Filed: Dec. 15, 1983

[51] Int. Cl.[4] ..... A47G 21/10; A47J 43/28

[52] U.S. Cl. ..... 294/99.2; 24/530

[58] Field of Search ..... 294/3, 5, 8.5, 11, 16, 294/33, 99 R, 99 SAJ; D7/105; 24/499-501, 507, 511, 530; 81/43; 128/354

[56] References Cited

U.S. PATENT DOCUMENTS

| | | | |
|---|---|---|---|
| 426,039 | 4/1890 | Mitchell | 294/8.5 |
| 1,133,388 | 3/1915 | Merrill | 24/530 X |
| 3,186,749 | 6/1965 | Dawes | 294/16 |
| 3,239,262 | 3/1966 | Rines et al. | 294/16 |
| 3,637,248 | 1/1972 | Arita | 294/16 |
| 4,199,180 | 4/1980 | Kelly | 294/16 X |

FOREIGN PATENT DOCUMENTS

| | | | |
|---|---|---|---|
| 811925 | 4/1937 | France | 294/99 SAJ |
| 866035 | 4/1961 | United Kingdom | 81/43 |

*Primary Examiner*—Johnny D. Cherry

*Attorney, Agent, or Firm*—John E. Wagner

[57] ABSTRACT

Disclosed is a chopstick holder comprising a unitary interrupted circular ring of resilient material having a pair of slots or openings in the side wall dimensioned to receive chopsticks. The openings are chordlike and adapted to receive chopsticks and hold them by friction against the side walls of the openings. The openings are angled whereby chopsticks inserted to the full depth of the opening are angled for natural grasping and use. Being of a single simple ring shape, the chopstick holders are easily fabricated and easily washable. Alternately, the chopstick holders are sufficiently low in cost that they may be discarded after a single use. Sufficient room is provided on the top for an advertising message.

2 Claims, 6 Drawing Figures

CHOPSTICK HOLDER

BACKGROUND OF THE INVENTION

The use of oriental chopsticks by occidentals has long constituted an embarrassing challenge. Typically, the occidental, when faced with the opportunity to use chopsticks to consume oriental style cooking, graciously declines. Others will attempt the use of chopsticks with little success and quietly deposit them on the table and pick up a fork with which they feel comfortable, and find that they can eat with self assurance and some efficiency. Some occidentals actually become proficient with the use of chopsticks, but most do not, and as a result, avoid the occasion of eating oriental food.

I have found that the greatest difficulty which learners have with the use of chipsticks is not the basic grasping of the chopsticks, or the picking up of food between the two tips, but rather the pivoting of the two sticks, which causes the food to be dropped and the chopsticks to cross in an embarrassing showing of lack of proficiency in their use. This common problem has been recognized by others and has been the subject of a number of patents covering chopstick holding devices of various types. Typical of such devices are those disclosed in the following patents:

| | | |
|---|---|---|
| 3,239,262 | J. Rines et al | 03/08/66 |
| 3,501,191 | L. Darr | 03/17/70 |
| 4,199,180 | J. L. Kelly | 04/22/80 |
| 3,323,825 | T. N. Arima | 06/06/67 |
| 3,807,781 | E. J. Rollband | 04/30/74 |
| 3,414,310 | H. Ono | 12/03/68 |
| 3,186,749 | G. A. Dawes | 06/01/65 |
| and 2,997,328 | W. F. Lee | 08/22/61 |

BRIEF STATEMENT OF THE INVENTION

Faced with this state of the art, I set about to produce an effective holder for chopsticks which prevents the chopsticks for crossing over, holds them in the proper position for use, provides slight springing action and may be used with disposable chopsticks and may be easily sterilized for reuse or is of such simplicity and low cost that it may be disposed of after a single use or may travel home with the satisfied customer as a complementary gift. The holder, in accordance with this invention is fabricated from a single piece of plastic material with no joints or pivots. Further, my chopstick holder will accommodate disposable wooden chopsticks which have variations in certain dimensions such as the width of the handle portion. These variations occur not only due to manufacturing tolerances but to the art of breaking apart dual chop sticks formed from a single piece of wood with a fracture line for the user to separate the two individual chopsticks.

I further sought and have achieved a chopstick holder which, when used, improves the grip of the holder on the chopsticks and discourages the possibility of becoming disengaged while in use.

These features are all accomplished in accordance with this invention which comprises an interrupted circle of plastic material exhibiting resilience or springiness to allow the circle to be distended outward, and more particularly to be sprung inward tending to close the gap in the circle. On opposite sides of the circle toward the gap are a pair of chordlike slots having a width which corresponds to the thickness of the chopsticks. The length of the chordlike slots is approximately one-third of the diameter of the circle of the holder. Chopsticks are inserted in the slots with the working tips of the chopsticks extending in the direction of the gap in the circle. The chopsticks are grasped between the holder and the tips, and pressure on the user's fingers tends to close the tips together while closing the gap of the holder against the springiness of the holder. The pressure of the user in bringing the tips together tends to force the chopsticks more deeply into the slots thereby increasing their security. After use, the chopsticks and holder may be discarded or the holder unsnapped from the chopsticks and retained by the user or washed, sterilized and reused.

BRIEF DESCRIPTION OF THE DRAWING

This invention may be more clearly understood from the following detailed description and by reference to the drawing in which.

DETAILED DESCRIPTION OF THE INVENTION

Figure 1:
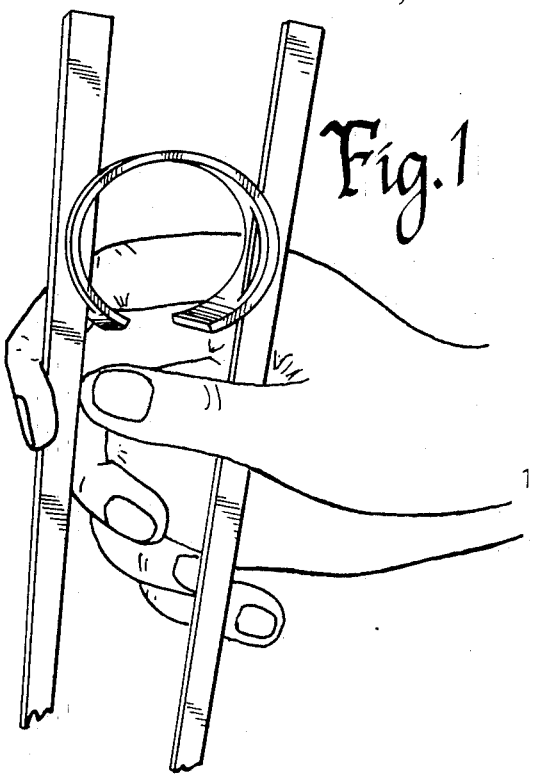
FIG. 1 is a perspective view of the diner using the chopstick holder of this invention.

For a clear understanding of this invention, refer now to FIG. 1. In this figure, the hand of the diner is shown grasping a pair of conventional, disposable chopsticks 11 and 12 in his right hand and ready to pick up morsels of oriental cooking. Barely visible in the region of his forefinger and below his thumb is the chopstick holder 13 of this invention which appears to be ringlike. In fact, the chopstick holder is an interrupted short tube with the interruption or gap located between the chopsticks and under the thumb of the diner in FIG. 1. To casual observers the diner is using chopsticks in the approved, unassisted manner. The holder, however, is aiding in positioning the chopsticks, holding them at the right angle for grasping the food morsels, preventing them from crossing over each other and providing a slight spring resistance to closing. The end result is that the diner can, with confidence, use chopsticks with the same ease as an oriental with a lifetime of experience.

Figure 2:
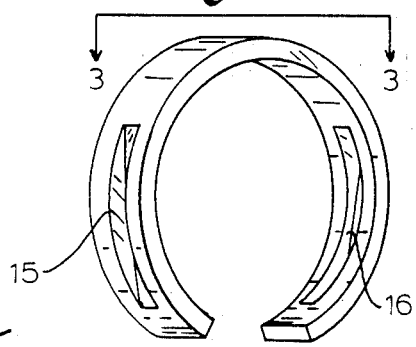
FIG. 2 is a perspective view of the holder of this invention detached from any chopsticks.
Figure 3:
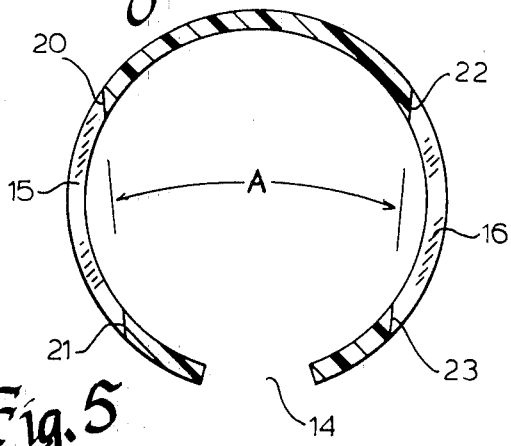
FIG. 3 is a sectional view along the line 3—3 of FIG. 2.
Figure 4:
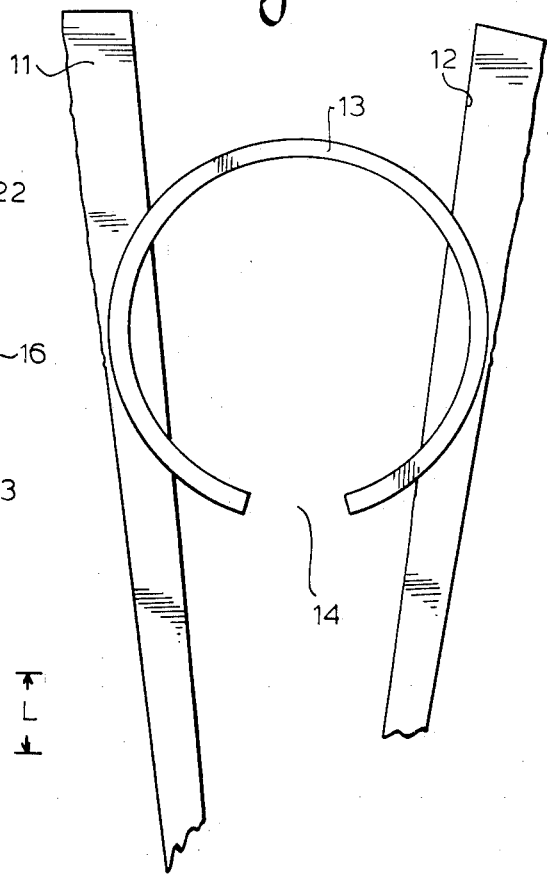
FIG. 4 is an enlarged fragmentary view of this invention showing the interrelationship of the chopsticks and the holder in use.

How this is accomplished is better illustrated in FIG. 2 in connection with FIGS. 3 and 4. In FIG. 2 the holder 13 may be seen as an interrupted circular tube having a diameter D in the order of $1\frac{1}{2}$ inches and a tube length in the order of $\frac{3}{8}$ inch. The gap 14 is in the order of $\frac{3}{8}$ inch in length when the holder 13 is unrestrained.

The holder 13 may be of molded plastic such as polyethylene or may be cut from tubing such as glass reinforced resin, commonly referred to as fiberglass. The molded material is preferred. The holder includes slots 15 and 16 which are integrally molded into the structure or may be produced by milling or sawing in the case of tubing.

The slots are angled with respect to each other toward the gap 14, as is best seen in FIG. 3. The preferred angle A is 7 degrees but angles of the slots may vary between 5 degrees and 20 degrees. The gap 14 subtends an angle in the order of 40 degrees at the center of the holder 13 and has a chord length of $\frac{1}{4}$ inch or the like. Although these dimensions are not intended to be limiting, they serve for defining the preferred embodiment of this invention.

Note that only a single piece of material is involved, and the similicity of its shape. Chopsticks 11 and 12 are pressed into the slots 15 and 16 from opposite sides of the holder 13. The natural resilience of wood allows the chopsticks to be press fit into the slots 15 and 16 on opposite sides of the holder. The angle of the chopsticks is naturally formed by the angled end walls 20 and 21 on one side and 22 and 23 on the opposite side of the holder. Pressure on the chopsticks by the diner in closing the gap between the tip of the chopsticks tends to force them into the slots 15 and 16. Note that the unevenness of the upper ends of the chopsticks is partly due to an uneven break of the chopsticks and does not affect their positioning in the slots. Use tends to tighten them in their slots as opposed to some prior art chopstick holders in which use tends to cause them to come out of their supporting member. Note also that no tube or retainer for each chopstick is required except for the integral slots.

Figure 5:
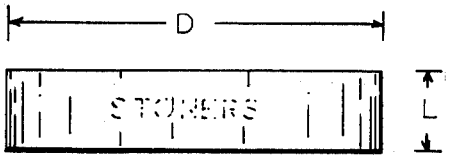
FIG. 5 is a top plan view of this invention showing the available space for an advertising message on this invention.
Figure 6:
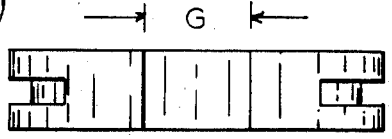
FIG. 6 is a bottom plan view of this invention showing the gap and slots thereon.

The material and shape of the holder 13 is such that it is easily washed and sterilized and reused. Optionally, the design is so simple and low in cost that the holder may be discarded or given to the diner as a take home souvenir. In this case, the holder 13 has another commercially significant feature. The unobstructed top of the holder 13 may carry identification or an advertising message as illustrated in FIG. 5, where a message is imprinted where it may easily be seen by the diner at a later time when he takes the holder home.

In general, I have invented a very simple design for a chopstick holder with no moving parts and no closed shapes which are difficult to clean. By its very nature, it may be cleaned by merely being tossed into a suitable washing and sterilizing apparatus.

For the diner, it is unobtrusive, effective and gives him a degree of flexibility in use to actually aid in training him to use chopsticks in the proper manner without assistance. After use of the holder of this invention for a few times, I am convinced that the diner can forego its use and thereafter become an accomplished user of chopsticks.

The foregoing embodiment of this invention is intended to be illustrative and the specific structure disclosed may be varied without departing from the spirit and scope of this invention. Instead, this invention is defined by the following claims including their equivalents.

What is claimed is:

1. A chopstick holder consisting of a unitary interrupted generally circular uniform dimension ring of resilient material;

said interrupted ring having a pair of ends defining a gap therebetween;

said interrupted ring further defining a pair of elongated arc-like slots in the wall thereof;

said elongated arc-like slots having a width corresponding to the thickness of a chopstick and having a length sufficient to confine one chopstick in each of said slots by frictional engagement of the sides of the chopstick with the sides of said slots after lateral insertion of chopsticks in said slots;

said slots positioned whereby a pair of chopsticks secured in respective slots are angled towards each other but with the ends out of contact and having sufficient spacing therebetween to allow the user to place a morsel of food therebetween;

said holder being compressible by the user sufficiently to allow the morsel to be picked up without the ends of the gap closing; and the pressure of the user in picking up a morsel being applied in a direction which urges the chopsticks into their respective slots.

2. A chopstick holder comprising an interrupted ring of resilient material;

said interrupted ring of resilient material including in the wall thereof a pair of oppositely positioned arc-like slots in the periphery thereof for receiving chopsticks by lateral insertion in respective slots and positioned and angled to receive a pair of chopsticks directed towards each other but not in contact;

said interrupted ring of resilient material having a gap therein of sufficient size whereby flexing of the ring inwardly by the chopsticks towards bringing the ends of the chopsticks into contact tends to close but does not close the gap in the interrupted ring prior to contact of the ends of the chopsticks.

* * * * *